US007780341B2

(12) United States Patent
Trifoni et al.

(10) Patent No.: US 7,780,341 B2
(45) Date of Patent: Aug. 24, 2010

(54) CLOCKWORK MOVEMENT

(75) Inventors: François Trifoni, Le Locle (CH); Stephen Forsey, Les Brenets (CH)

(73) Assignees: Vaucher Manufacture Fleurier S.A., Fleurier (CH); CompliTime S.A., La Chaux-de-Fonds (CH)

( * ) Notice: Subject to any disclaimer, the term of this patent is extended or adjusted under 35 U.S.C. 154(b) by 300 days.

(21) Appl. No.: 12/094,827

(22) PCT Filed: Nov. 21, 2006

(86) PCT No.: PCT/EP2006/068695

§ 371 (c)(1),
(2), (4) Date: May 23, 2008

(87) PCT Pub. No.: WO2007/060153

PCT Pub. Date: May 31, 2007

(65) Prior Publication Data

US 2008/0310258 A1 Dec. 18, 2008

(30) Foreign Application Priority Data

Nov. 24, 2005 (EP) ..... 05111270

(51) Int. Cl.
*G04F 7/00* (2006.01)
*G04B 27/02* (2006.01)

(52) U.S. Cl. ..... 368/106; 368/190

(58) Field of Classification Search ..... 368/101, 368/106, 190, 196, 308, 319
See application file for complete search history.

(56) References Cited

U.S. PATENT DOCUMENTS

| | | | | |
|---|---|---|---|---|
| 3,901,020 | A * | 8/1975 | Capt et al. | 368/105 |
| 5,793,708 | A * | 8/1998 | Schmidt et al. | 368/106 |
| 6,247,841 | B1 | 6/2001 | Erard | |
| 6,428,201 | B1 * | 8/2002 | Shibuya et al. | 368/106 |
| 7,029,169 | B2 * | 4/2006 | Takahashi et al. | 368/106 |
| 7,359,289 | B2 | 4/2008 | Saunier | |

FOREIGN PATENT DOCUMENTS

| | | |
|---|---|---|
| CH | 12 518/73 | 12/1975 |
| EP | 0 985 984 A1 | 3/2000 |
| EP | 553 468 A1 | 7/2005 |

* cited by examiner

*Primary Examiner*—Vit W Miska
(74) *Attorney, Agent, or Firm*—Young & Thompson

(57) ABSTRACT

A clockwork movement includes at least two control elements which are movable with respect to the frame thereof, are used for interacting with the same external control member in response to the activation thereof and are positioned remotely to each other in the direction of the clockwork movement thickness. The clockwork movement has an intermediate connecting unit which is rotatable about an axis substantially extending in the direction of the clockwork movement thickness, pivotally mounted on the clockwork movement frame element and provided with a reception area which is distant from the axis and exposable to a force produced in response to the control member activation. The intermediate unit also includes at least two contact areas each of which is used for producing a force on the corresponding control element and which are located on both sides of the reception area in the direction of the axis.

11 Claims, 4 Drawing Sheets

CLOCKWORK MOVEMENT

TECHNICAL FIELD

The present invention relates to a clockwork movement of the mechanical or automatic type. In particular, the invention concerns a control element, implemented in a movement of this type, designed to cooperate with an external control member once the movement is assembled in a case of the timepiece.

More specifically, the clockwork movement according to the invention comprises at least a first and a second control member which are movable with respect to a frame of the movement and designed to cooperate with a same external control member in response to activation thereof.

STATE OF THE ART

A case of this type exists, for example, in a clockwork movement comprising means for the implementation of a chronograph function, whereof the display means comprise minute and hour chronograph counters. In this type of pieces, available space may be lacking on one of the faces of the movement, such that the component pieces of a same mechanism may be arranged some on the bar side, and others on the dial side of the movement. For example, in some chronographs, the control and return-to-zero devices of the chronograph and minute counters are arranged on the bar side of the movement, the control and return-to-zero devices of the hour counter being arranged on the dial side of the movement. A watch provided with a movement of this type must comprise a single control member to return all of the counters to zero simultaneously. In other words, this control member must be arranged so as to act simultaneously on the return-to-zero devices, on one hand, of the chronograph and minute counters, and on the other hand, of the hour counter.

An example of this type of movement is described in the work entitled "Théorie d'horlogerie", by C. -A. Reymondin et al. and published by the Fédération des Ecoles Technique (Switzerland), on page 244. The corresponding excerpt, found in the chapter related to chronograph movements, describes the operation of an hour counter of a conventional chronograph. The illustrations on this page show that, to perform a return-to-zero of the hour counter, control members shared with those used to return the minute and second counters to zero are implemented. More specifically, a push-piece is arranged in the plate of the movement to move a pin for locking the return-to-zero hammers of the minute and second counters, when it is pressed. The pin and these hammers are conventionally arranged on the bar side of the movement. During its movement, the pin crosses a notch arranged in the minute and second hammers. Simultaneously, the push-piece abruptly sinks further into the plate to push a support surface of a return-to-zero hammer of the hour counter arranged on the plate side of the movement, conventionally. Thus, during a same return-to-zero operation, the same push-piece acts sequentially on two return-to-zero members arranged on both sides of the plate of the movement.

Such structures do, however, raise a certain number of positioning, tolerance and adjustment problems.

In the particular case of a chronograph movement with hour counter, these problems are all the more significant in that they can have consequences on the quality and/or simultaneity of the return-to-zero of the display means for time measured. Indeed, the movements of the return-to-zero hammers, caused by the movements of the levers controlled by the external control member, must be extremely precise. Such precision requires a great mastery of the connection between the control member and the return-to-zero levers.

The requirement of this precision is even stronger in the case of a movement implementing a vertical coupling and in which at least one of the hammers is not released during a return-to-zero operation, but is actively lowered under the effect of the user's action. In this case, the movement of the hammer depends directly on that of the return-to-zero lever.

BRIEF DESCRIPTION OF THE INVENTION

The primary aim of the present invention is to overcome the drawback of the abovementioned prior art, by proposing a clockwork movement having a structure offering greater flexibility in the dimensioning and positioning of an external control member designed to act jointly on two control members of the movement. This type of flexibility is the result of better control of movement transmission from the external control member to the movable control elements of the movement.

To this end, the present invention concerns a movement of the type described above, characterized by the fact that it comprises an intermediate connecting unit which is rotatable around an axis X substantially extending in the direction of the clockwork movement thickness, on a frame member of the movement. The intermediate unit has a reception area, which is distant from the axis X, designed to undergo a force in response to an activation of the control member. Moreover, the intermediate unit comprises at least two contact zones, each of which is arranged to exert a force on one of the respective control members, the contact areas being located on both sides of the reception area in the direction of the axis X, respectively.

Thanks to these characteristics, the control elements, on one hand, and the intermediate connecting unit, on the other hands can be positioned precisely in relation to the frame of the movement, thereby ensuring good relative positioning of all of these elements. Moreover, in the case where the intermediate connecting unit is arranged to come directly into contact with the external control member, when the latter is actuated, the positioning and dimensioning of its reception area are clearly more flexible than in the case of the support surfaces previously mentioned, relative to the state of the art. The reception area can be made with a sufficiently large surface to allow better flexibility, relative to the state of the art, in choosing the structure of the external control member as well as in its positioning in a watch case wherein the movement must be housed.

Preferably, the movement according to the present invention also comprises means for implementing a chronograph function comprising, in particular, chronograph, minute and hour counters, as well as the return-to-zero levers and hammers. The movement also comprises a hollow post around which the intermediate connecting unit is rotatably engaged, said assembly being arranged to act on the return-to-zero hammers. The post preferably has an annular clot whereon the intermediate unit pivots, around the axis X, and arranged such that the unit can also pivot slightly around at least one second axis perpendicular to the axis X. This last characteristic advantageously makes it possible to increase the tolerances allowable on the adjustment of the hammers relative to the counters, to such an extent that the conventional hammer timepiece adjustments can be omitted. Indeed, the additional pivoting of the intermediate assembly performs a dynamic adjustment function of the travel of the hour counter hammer relative to the minute and second hammers.

BRIEF DESCRIPTION OF THE DRAWINGS

Other characteristics and advantages of the present invention will appear more clearly upon reading the detailed description of one preferred embodiment which follows, done in reference to the appended drawings provided as non-limiting examples and in which.

DETAILED DESCRIPTION OF THE DRAWINGS

The clockwork movement with chronograph function according to one preferred embodiment of the present invention is designed to be arranged in a chronograph watch with analog display (not shown) of the conventional type.

A watch of this type in particular comprises respective display members for seconds, minutes and hours measured, respectively supported by second, minute and hour counters.

Figure 1:
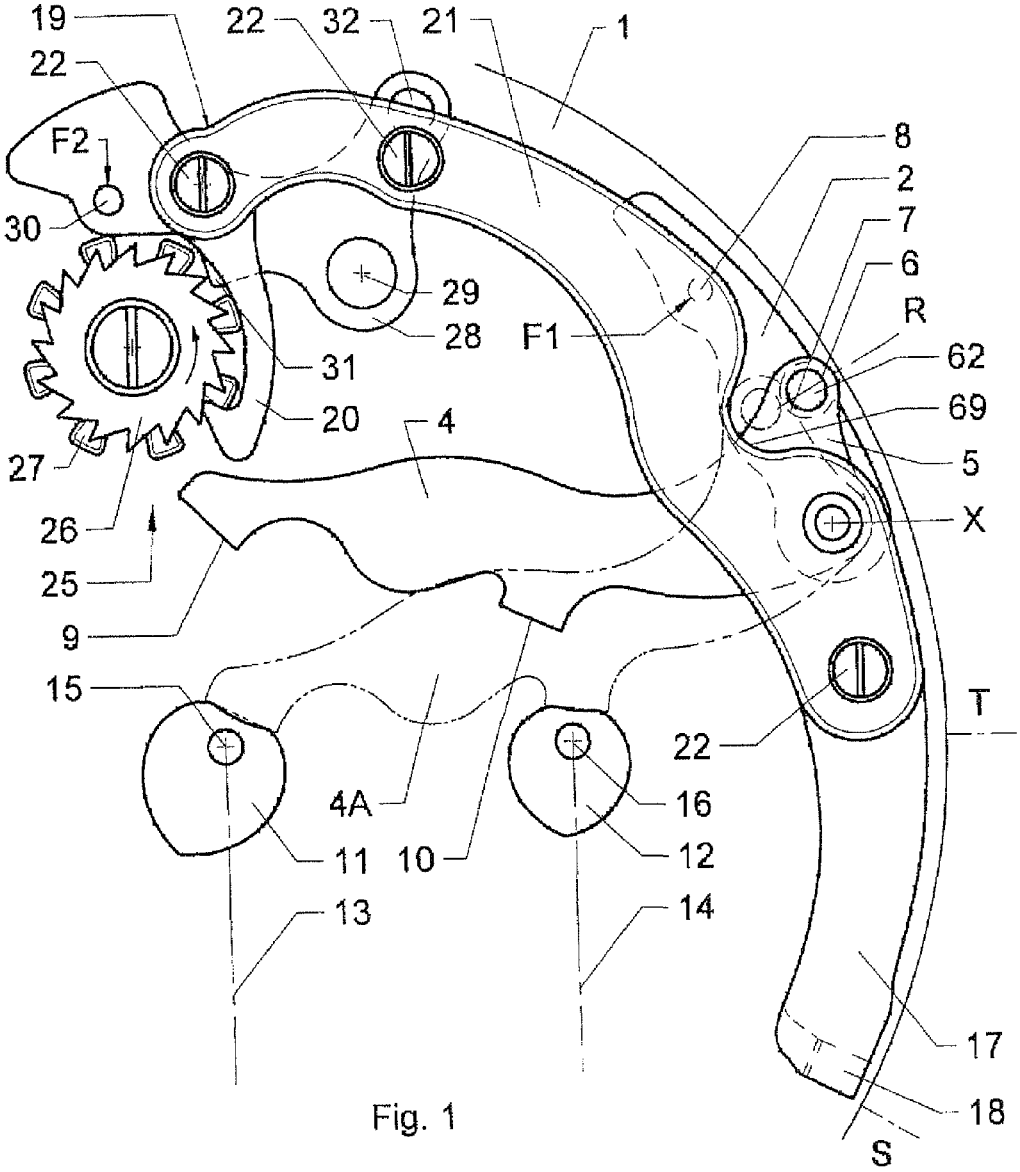
FIG. 1 shows a simplified elevation view of a first part of the return-to-zero members for chronograph movement according to one preferred embodiment of the present invention.
Figure 2:
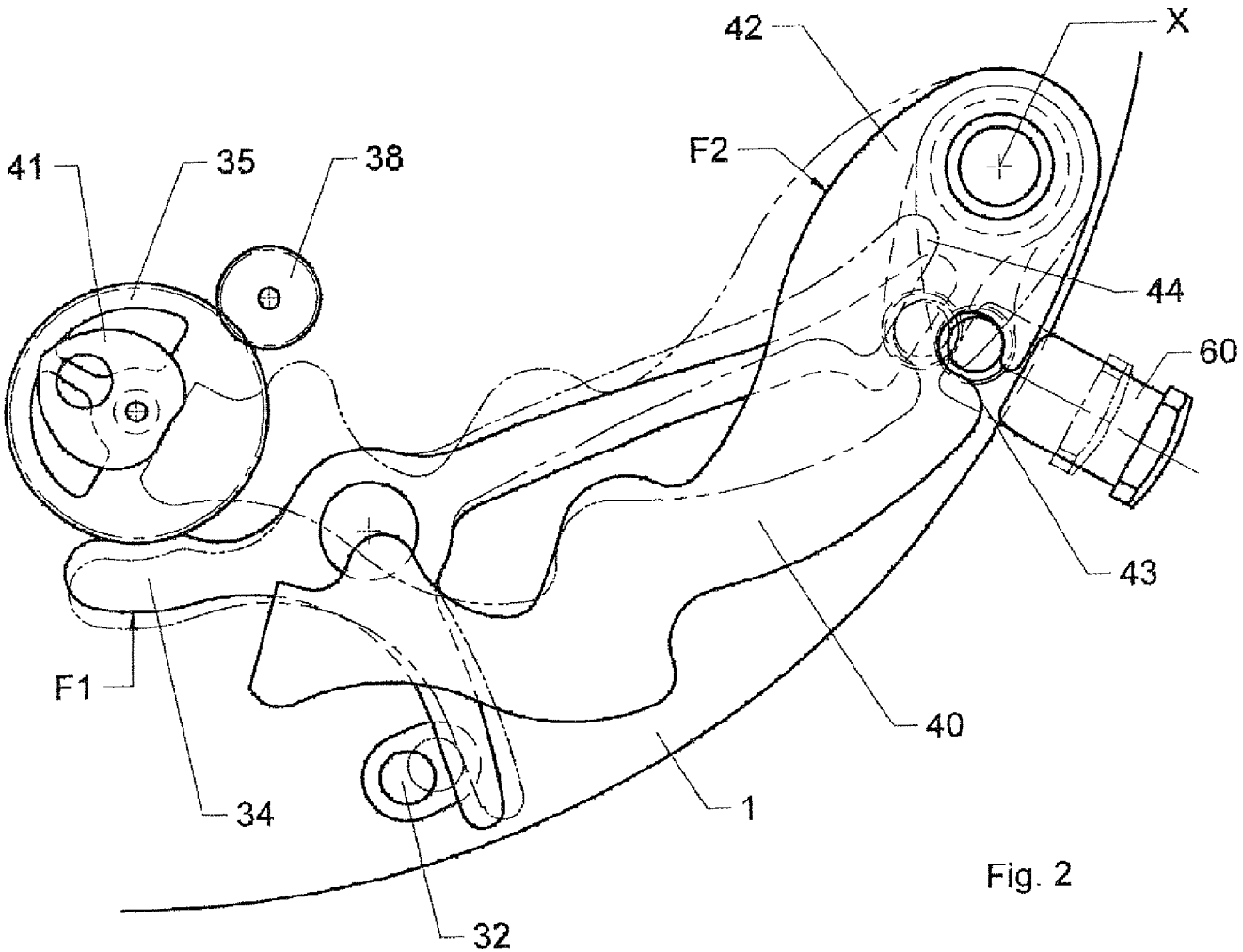
FIG. 2 shows a simplified elevation view of a second part of the return-to-zero members for the chronograph movement from FIG. 1.

FIGS. 1 and 2 show, in a simplified way, component elements of the clockwork movement according to the present invention coming into play in particular during the return-to-zero of the second, minute and hour counters. We have primarily shown the elements of the clockwork movement which are essential to a good understanding of the invention, out of a concern for clarity.

Also, in the following description, the position of certain components is sometimes defined in reference to an hour. This position corresponds to that occupied, on a conventional dial, by the index displaying the given hour.

In FIGS. 1 and 2, a peripheral portion of the plate 1 of the movement was shown in the region designed to cooperate with the external control members (not shown) in the corresponding time piece. A return-to-zero lever 2 is arranged to be actuated by an external return-to-zero control member, diagrammed by an axis line bearing the reference R in the figures. More specifically, the lever 2 has a pivot-type connection, with an axis X, with the plate 1 and follows a rotational movement relative to the plate in response to pressure exerted on the external control member.

On the other hand, the position of a setting member or stem (not shown) has also been diagrammed by an axis line bearing the reference T. Likewise, the position of an additional control member has been diagrammed by an axis line bearing the reference S, this same control member being designed to activate or deactivate the chronograph function. As non-limiting information, one can note that, when the clockwork movement is mounted in a case to assembly a timepiece, the axis R is positioned at four o'clock while the axis T is positioned at three o'clock and the axis S at two o'clock.

A return-to-zero hammer 4 is positioned in relation to the plate, so as to be moved in response to an action on the return-to-zero external control member.

The nature of the movement of the hammer 4 is not directly related to the present invention and can be of any type adapted to the implementation of the latter. Thus, in the present embodiment, it is arranged so as to be able to rotate relative to the plate 1 of the clockwork movement, around the axis X. One also sees, in FIG. 1, that the base 5 of the hammer 4 comprises a circular opening 6 which is superimposed over a similar opening 7 of the return-to-zero lever and the function of which will be described below, in relation to the description of FIG. 3.

The return-to-zero lever 2 comprises an additional pin 8, in its part positioned remotely from the axis X, designed to serve as a support for the end of a spring (not shown) exerting a force on the lever 2, this force being diagrammed by an arrow referenced by F1 in FIG. 1, tending to keep it in its position of rest, i.e. in the position shown in thick lines in FIG. 1. One preferably provides for a notching conventionally formed on the spring to allow rapid action of the return-to-zero control.

The hammer 4 is provided with two support surfaces 9 and 10 designed to be moved in contact with heart-pieces 11 and 12 during the return-to-zero operation of the minute counters.

The heart-pieces 11 and 12 and the hammers were shown diagrammatically insofar as they are conventional and do not present any particular difficulty for one skilled in the art. Each of the heart-pieces is mounted on a minute counter mobile (not shown) supporting a hand indicating a timed unit of time.

Thus, a hand 13 indicating the second timed and a hand 14 indicating the minute timed were diagrammed in the figures. The hands 13 and 14 were shown in their initial positions in FIG. 1, which corresponds to a stop situation after returning the chronograph function to zero. The hammer 4 is shown in solid lines in its raised position to allow any rotation of the heart-pieces 11, 12 of the chronograph mobiles relative to their respective axes of rotation 15 and 16. We have also shown the hammer, in thin lines with the reference 4A, when it is actuated by the external control member to return the minute counters to zero, the heart-pieces 11 and 12 then being oriented according to FIG. 1.

We have also shown a control device in FIG. 1 designed to initiate or stop measurements of time intervals.

The control device of the clockwork movement according to the present invention in particular comprises a control lever 17 substantially extending between the two o'clock and six o'clock positions, bordering the periphery of the plate 1. The general production of the control lever 17 is conventional.

A first end 18 of the control lever, arranged at two o'clock, is located across from the external control member when the movement is housed in a clockwork case.

The second end 19 of the control lever bears an operating-lever hook 20 of the type known in the prior art. According to the preferred embodiment shown and described, the control device comprises a small plate 21 made integral with the control lever 17 via a plurality of screws 22. The small plate 21 has a shape such that it superimposes a significant part of the control lever, substantially from the three o'clock position to the second end 19, One of the screws 22, arranged at the level of the second end 19 of the control lever, goes through an adapted hole (not visible) arranged in the operating-lever hook 20 to make the latter integral both with the control lever 17 and the small plate 21, while also being free to rotate in relation to the axis of the screw 22.

Activation of the control lever 17, through translation of the operating-lever hook 20 along the axis S, causes movement of the operating-lever hook 20 acting on a rotating control member, shown here in the form of a column wheel 25.

The column wheel 25 comprises a ratchet 26, whereon the operating-lever hook 20 acts, as well as columns 27 integral with the ratchet 26 and the number of which is preferably equal to half the number of teeth of the ratchet. Thus, the column wheel 25 completes a rotation of one half-pitch, in the counterclockwise direction, in response to each pressure exerted on the control lever 17, a pitch corresponding to the angle separating one column 27 from the next. A column wheel jumper (not shown) is arranged conventionally to lock the toothing of the ratchet in each of its positions, two adjacent positions being separated by an angular half-pitch.

The columns 27 cooperate with a plurality of component elements of the movement according to the present invention, according to the angular state of the column wheel 25 in relation to the plate 1.

In particular, the columns 27 control movements of a yoke 28 of the hour counter, rotatably mounted on the plate via a stepped screw 29. The yoke comprises a pin 30 against which a spring (not shown) exerts a force F2, in the direction of the column wheel 25, as well as a beak 31 cooperating with the columns 27 to cause the yoke to turn in one direction or the other, in a known manner.

The yoke also comprises a pin 32 going through the plate to control an hour counter mechanism (described in relation with the description of FIG. 2) located on the dial side of the movement.

FIG. 2 shows a simplified elevation view of the hour counter mechanism.

Conventionally, the pin 32 of the yoke of the hour counter acts on a brake-lever 34, rotatably mounted on the plate, to cause it to turn in relation to its pivot 33. The brake lever 34 thus moves to alternatively block and release a wheel 35 of the hour counter designed to drive a hand for timed hours. Driving of the wheel 35 is done in a known manner by a setting wheel 38, itself driven from a drum of a barrel of the movement (not shown). The setting wheel comprises a traditional friction system (not visible) to avoid damaging the hour counter mechanism when the brake-lever acts on the wheel 35 or during return-to-zero operations.

The mechanism also comprises a return-to-zero hammer 40 of the hour counter, mounted on the rotating plate relative to the axis X and retained by a spring (not visible) integral with the plate. The hammer is arranged to cooperate with a heart-piece 41 supported by the hour counter for the purpose of returning said hour counter to zero. On the other hand, the hammer 40 has a base 42, arranged in the peripheral region of the plate 1, having an opening 43 in a shape similar to those of the hammer 4 of the minute and second counters and the return-to-zero lever 2. The base 42 of the hammer 40 is designed to undergo pressure when the external return-to-zero control is actuated, as will be explained in detail below, in relation to the description of FIGS. 3 and 4.

One also sees, in FIG. 2, that the brake-lever 34 has an end portion 44 arranged opposite the external return-to-zero member. When the latter is actuated to act on the hammer 40, it exerts slight pressure on the end portion 44 when arriving at the end of travel, with the goal of lifting the brake-lever of the wheel 35 and allowing the rotation thereof.

Figure 3:
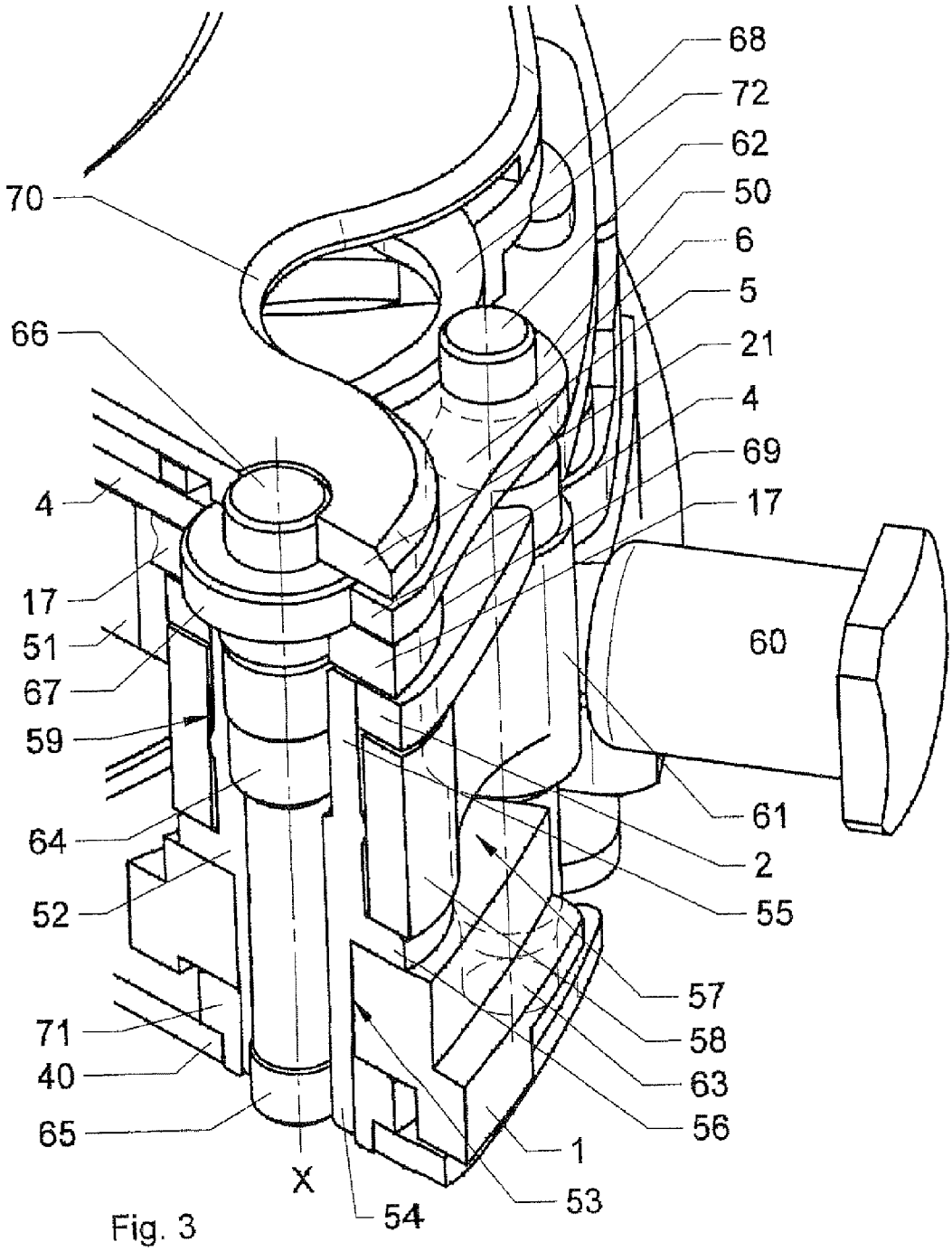
FIG. 3 is a perspective view of a construction detail of the movement of FIG. 1.

FIG. 3 shows a perspective and partial cross-sectional view of the movement region according to the present invention in the region located toward the four o'clock position.

One sees that a space is arranged between the control lever 17 and the small plate 21, in the region of the base 5 of the return-to-zero hammer 4, this hammer being inserted between the control lever 17 and the small plate 21. This type of structural characteristic makes it possible to ensure good wedging of the base 5 of the hammer between the two plane portions defined by the control members 17 and 21. One can provide that the distal part of the hammer, i.e. that bearing the support surfaces 9 and 10, rests on adapted support surfaces (not visible) of the chronograph bar.

Moreover, it is also apparent from this figure that the control lever 17 advantageously rotates around the pivot axis X of the return-to-zero lever 2 and hammer 4.

One will note that, in this configuration, a space must be provided, between the return-to-zero lever 2 and the hammer 4, sufficient for the control lever 17 to be able to move freely therein.

A hollow post 52 with an axis X is molded in an adapted hole 53 of the plate 1 while having a first end 54 located beyond the plate from the dial side of the movement, while its second end 55 is located in the region of the chronograph bars. The axial positioning of the post 52 is ensured by the arrangement of a step 56, formed in a single piece with the post, abutting against the plate.

An intermediate connecting unit 57 is engaged, free in rotation, on the post 52 via a principal portion 58 comprising a hole 59 along the axis X. The principal portion of the unit extends while substantially bordering the periphery of the plate in the direction of the four o'clock position. The four o'clock position is symbolized by the simplified illustration of a push button 60 arranged in the direction of the axis R of FIG. 1.

The principal portion 58 ends, substantially across from the four o'clock position, in a second portion 61 having a generally cylindrical shape with an axis parallel to the axis X. Thus, the median area of the second portion is arranged along the axis R and defines a reception area (marked by reference 100 in FIG. 4) whereon the push-piece is able to act.

The second cylindrical portion 61 bears, on both sides of the reception area, cylindrical fingers 62, 63 which have a diameter smaller than the diameter of the second portion and which are connected to said second portion via short tapered portions. A first finger 62 extends from the second portion to the region of the chronograph bars, while the second finger 63 extends from the second portion into the region of the plate.

An arbor 64 is also engaged inside the post 52 while rotating freely around the axis X. The arbor has a first end 65 which cooperates with the first end 54 of the post, via a clot having an adapted diameter, while its second end 66 is located outside the post, in the region of the chronograph bars. The arbor 64 has, across from the second end 55 of the post, a clot similar to that of its first end. These two cylindrical clots thus define two adjusted pivot regions of the arbor 64 relative to the post 52.

The arbor 64 also comprises an annular step 67 at a small distance from its second end 66, defining a first shoulder, dial side, as well as a second shoulder, bar side.

As previously mentioned relative to the description of FIG. 1, a plurality of components of the movement control mechanisms according to the invention have a same axis X of rotation relative to the frame of the movement, namely the plate in particular.

Thus, by following the axis X from the intermediate connecting unit 57 in the direction of the chronograph bars, the unit is followed by the return-to-zero lever 2, the control lever 17, the second and minute hammer 4 and the small plate 21.

The return-to-zero lever 2 is engaged on the post 52 so as to be able to rotate thereon. Moreover, the lever is made integral in rotation with the intermediate connecting unit 57 through cooperation of its opening 7 with the second portion 61 of the intermediate unit, their respective diameters being adapted.

The control lever 17 is press-fitted on the arbor 64 while being positioned bearing against the first shoulder of the arbor, while the small plate 21 is engaged around the second end 66 of the arbor from the side of its second shoulder.

The hammer 4 is arranged around the step 67 of the arbor, between the control lever 17 and the small plate 21, these elements making it possible to ensure the axial maintenance thereof. The opening 6 of the base of the hammer cooperates with the first finger 62 of the intermediate connecting unit to make the hammer integral with the unit during rotational movements of the axis X.

One also sees in FIG. 3 that the first finger 62 of the intermediate unit extends beyond the hammer to define a banking for a return-to-zero control spring 68. This spring exerts pressure on the first finger in a direction opposite the direction of the pressure exerted upon activation of the push button 60, tending to return the unit 57 to its position of rest, which is the position shown in FIG. 3.

Moreover, the control lever 17 and the small plate 21 have similar unlockings 69 and 70, to allow the movement of the first finger 62 and the second portion 61 of the intermediate unit, from the bar side of the principal portion, during actuation of the return-to-zero lever.

From the side of its first end 54, the post 52 ensures positioning and guiding of a bush 71 supporting the hammer 40 of the hour counter, the bush being free to rotate relative to the post.

On one hand, the hammer of the hour counter is press-fitted on the bush so as to be integral with said bush during rotational movements relative to the axis X. On the other hand, the second finger 63 of the intermediate connecting block is engaged in the opening 43 of the hammer of the hour counter.

The advantages of the structure according to the present invention are clearly shown with the illustration of FIG. 3. One sees, in fact, that six component elements of the control mechanisms rotate on a same axis, namely the axis X, which greatly simplifies the known structures.

Moreover, the implementation of the intermediate connecting block 57 makes it possible to drive three of these elements in rotation simultaneously, in response to the actuation of the push button 60 arranged at four o'clock. Thanks to this characteristic, the implantation of the push button in the watch case is simplified, as the region of the intermediate connecting unit able to serve as the reception area 100 of the push button is extended. Moreover, the precise positioning of the intermediate unit 57 relative to the plate 1 of the movement ensures the good positioning of the three contact areas acting on the minute and second hammer 4, on the hour hammer 40 and on the return-to-zero lever 2, in relation to these elements during actuations of the push button. Moreover, this positioning is made independent of the position and dimensions of the end of the push button acting on the reception area 100 of the intermediate connecting unit.

One additional advantage of the structure shown in FIG. 3 resides in the fact that the first finger 62 of the intermediate unit also serves as banking for the return-to-zero spring 72, this function traditionally requiring the implementation of an additional fixed piece on the second and minute hammer 4.

Moreover, a yoke for locking of the return-to-zero lever 2 is preferably provided. For example, this yoke can be arranged to pivot between two extreme positions depending on the state of the column wheel 25. In one position of the latter corresponding to a time measurement interval, the yoke is arranged across from the return-to-zero lever so as to block the rotation thereof. In this situation, the actuation of the return-to-zero push button is neutralized.

Figure 4:
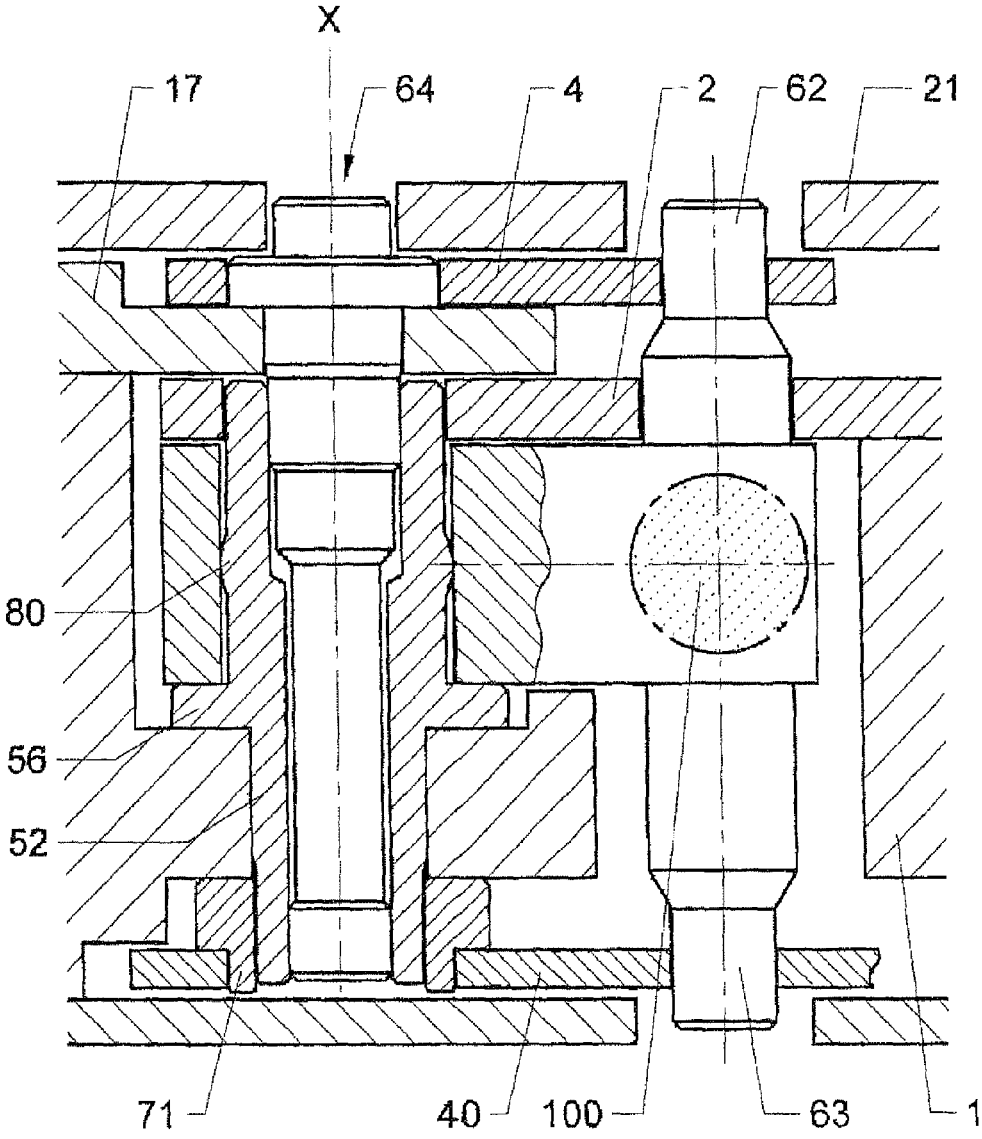
FIG. 4 is a cross-sectional view of a construction detail of the movement, according to one preferred variation, done along a plane perpendicular to the mean plane of the movement and containing the line L of FIG. 3.

FIG. 4 shows a cross-section of a detail of the control mechanisms of FIG. 3, according to one preferred variation of embodiment of the present invention.

One sees, in this figure, that the hollow post 52 is provided with a clot 80 arranged across from a position located substantially halfway up the primary unit 58 of the intermediate connecting unit 57. The respective diameters of this clot 80 and the hole 59 of the intermediate unit are adjusted such that the unit can rotate freely in relation to the post. Insofar as the external diameter of the post is slightly smaller than the diameter of the hole of the intermediate unit, the unit is able to rotate slightly around an infinity of axes contained in the median plane of the clot 80.

This type of additional characteristic is particularly advantageous in the case of a chronograph movement, when the intermediate unit is arranged to control the movement of the hammers. Indeed, the adjustment of the support surfaces of the hammers is generally a delicate operation in the assembly of a chronograph movement. This operation is even more delicate in the case of a movement such as that shown in which two hammers are arranged on both sides of the movement, respectively. In addition to the adjustment of the support surfaces designed to return the second and minute counters to zero, one in relation to the other, the support surface designed to return the hour counter to zero must be precisely adjusted relative to the first two.

Typically, when the external return-to-zero control member 60 is actuated, the hammers 4, 40 are driven in rotation simultaneously by the first and second fingers 62, 63 of the intermediate unit. It is then possible that once the support surfaces for the second and minute counters are in contact with the corresponding heart-pieces, the support surface for the hour counter not to have completely managed to return the heart-piece of the hour counter to its zero position, due to a slightly too-short length of the hammer 40. Of course, the inverse situation is also possible, namely travel of the second and minute counter hammer which is too short relative to that of the hour counter.

This type of situation requires the intervention of an horologist to adjust the respective dimensions of the hammers during production of a conventional movement.

In the movement according to the preferred embodiment, the ability of the intermediate unit 57 to rotate obtains a certain play in the travel of the support surfaces of the hammers during return-to-zero operations. Indeed, in the situation described above, the fact that the hammer 40 of the hour counter is not in abutment will cause the intermediate unit 57 to rotate around an axis perpendicular to the axis X cutting through the clot 80, to make it possible to lengthen the travel of the corresponding support surface and therefore allow a precise return-to-zero of the hour counter.

Moreover, one can note that because of the significant height of the second portion of the intermediate unit, a sufficient lever arm can be obtained, at the level of the second finger 63 of the unit 57, to guarantee the necessary play for a precise return-to-zero, without damaging the sensation felt by the user of such a watch. A low pivot amplitude of the intermediate connecting unit is sufficient to ensure a sufficient travel for the support surface of the hour hammer, while notably decreasing the tolerances to be respected during production of the hammer.

Of course, the clockwork movement according to the present invention is not limited to the implementation of a column wheel as rotatable control element, a conventional cam being able to be used in the alternative.

In one additional variation of embodiment, one can provide for the implementation of a hammer of the second and minute counters in two parts connected by a ball and socket joint, as described in European application no. 05 111 267.0 in the name of the Applicant filed the same day as the present application. Advantageously, this ball and socket joint enables a first dynamic adjustment of the two support surfaces of the hammer 4, while the rotation of the intermediate connecting block 57 relative to the clot 80 makes it possible to combine the first adjustment with an additional dynamic adjustment of the travel of the hour counter hammer 40.

Moreover, the hour counter hammer can also comprise a curved contact tab, alternatively, without damaging the qualities of the present invention in terms of precision. Likewise, the number or order of the elements simultaneously controlled by the movements of the intermediate connecting unit are not limiting.

A similar unit could be used to control, for example an alarm mechanism comprising an indicator of the operating state of the alarm, a countdown, or any other device for which an external action is required and which involves the actuation of at least two pieces arranged in different planes. One can also provide that the actuation of the two pieces is not simultaneous, as needed, without going outside the framework of the present invention.

The invention claimed is:

1. A clockwork movement comprising at least a first and a second control element which are movable relative to a frame of the movement and designed to cooperate with a same external control member in response to an activation thereof, wherein it comprises an intermediate connecting unit, which is pivotally mounted around an axis X substantially extending in the direction of the clockwork movement thickness, on a frame element of the movement, and having a reception area which is distant from the axis X and designed to undergo a force in response to an activation of said control member, and wherein said intermediate unit comprises at least two contact areas, each of which is arranged to exert a force on one of said respective control elements, said contact areas being located on both sides of said reception area in the direction of said axis X, respectively.

2. The clockwork movement according to claim 1, wherein it comprises an arbor pivotally mounted in relation to said frame element, around said axis X, and on which at least one of said mobile control elements is rotatably mounted.

3. The clockwork movement according to claim 1, wherein said intermediate connecting unit is arranged to come into contact with said mobile control elements simultaneously in response to an activation of said external control member.

4. The clockwork movement according to claim 3, wherein said intermediate connecting unit is pivotally engaged around a hollow post, which has an axis X, press-fitted into one of said fixed frame elements and inside which said arbor pivots.

5. The clockwork movement according to claim 4, wherein said intermediate connecting unit comprises a principal portion extending in a general direction substantially perpendicular to the direction of said axis X and comprising, near a first end, a hole through which it is engaged around said post and, near its second end, a first and a second finger extending on both sides of said principal portion, in respective directions substantially parallel to the direction of said axis X, and each supporting one of said contact areas.

6. The clockwork movement according to claim 5, when the movement has means for implementing a chronograph function, in particular a first counter of a first unit of time and a second counter of a second unit of time as well as a first and a second return-to-zero hammer for said first and second counters, respectively, wherein a first of said mobile control elements is integral with said first hammer while the other mobile control element is integral with said second hammer.

7. The movement according to claim 6, wherein it also comprises a return-to-zero lever pivotally mounted on said post and integral in rotation with said intermediate connecting unit, said return-to-zero lever supporting a finger designed to cooperate with a notched spring integral with said frame.

8. The clockwork movement according to claim 7, wherein it also comprises a yoke for locking said return-to-zero lever which is able to move between a first and a second extreme position, corresponding to the operating and stopped states of said chronograph function, respectively, said locking yoke being arranged across from said return-to-zero lever in said first extreme position at least to limit the pivoting thereof.

9. The clockwork movements according to claim 6, wherein said post has a step which said intermediate connecting unit is arranged bearing against, as well as an annular clot having an external diameter slightly smaller than the diameter of said hole and arranged across from a median region of said principal unit to define a ball and socket joint between said post and said intermediate unit.

10. The clockwork movement according to claim 2, wherein it also comprises a control lever designed to be pivoted in response to an activation of an additional control member, said control lever being integral with said arbor having an axis X.

11. The clockwork movement according to claim 2, wherein said intermediate connecting unit is arranged to come into contact with said mobile control elements simultaneously in response to an activation of said external control member.

* * * * *